US006425782B1

(12) United States Patent
Holland

(10) Patent No.: US 6,425,782 B1
(45) Date of Patent: Jul. 30, 2002

(54) END CONNECTOR FOR COAXIAL CABLE

(76) Inventor: Michael Holland, 4219 Transport St., Ventura, CA (US) 93003

( * ) Notice: Subject to any disclaimer, the term of this patent is extended or adjusted under 35 U.S.C. 154(b) by 0 days.

(21) Appl. No.: 09/716,021

(22) Filed: Nov. 16, 2000

(51) Int. Cl.[7] ..... H01R 9/05
(52) U.S. Cl. ..... 439/585; 439/578
(58) Field of Search ..... 439/578, 583, 439/584, 585, 271

(56) References Cited

U.S. PATENT DOCUMENTS 4,990,106 A * 2/1991 Szegda ..... 439/585
5,083,943 A * 1/1992 Tarrant ..... 439/585
5,141,451 A * 8/1992 Down ..... 439/585
5,975,949 A * 11/1999 Holliday et al. ..... 439/585
5,997,350 A * 12/1999 Burris et al. ..... 439/585
6,080,015 A * 6/2000 Andreescu ..... 439/584
6,217,383 B1 * 4/2001 Holland et al. ..... 439/578

* cited by examiner

*Primary Examiner*—Tho D. Ta
(74) *Attorney, Agent, or Firm*—Troxell Law Office PLLC

(57) ABSTRACT

An end connector for coaxial cable usable for connecting a coaxial cable to an electronic device or a threaded interface connector, the end connector being able to accept a coaxial cable coaxially. The connector includes an outer sleeve, a sleeve body coaxially disposed in the outer sleeve, an adapter, and a nut lock encircling around the sleeve body. At least one annular protrusion is formed around the outer surface of the outer sleeve, when the cable is inserted into the end connector, both outer sheath and the braided conductor of the cable are filled into an annular hollow portion of the outer sleeve. When being squeezed, the outer sleeve is curled inwardly such that the annular protrusion is squeezed and forced to directly in tight engagement with the cable outer sheath.

6 Claims, 12 Drawing Sheets

END CONNECTOR FOR COAXIAL CABLE

BACKGROUND OF THE INVENTION (1) Field of the Invention

The present invention relates to an end connector for coaxial cable, and more particularly, to an end connector for sealably connecting a coaxial cable to a wired television receiver or other electronic terminal device using an adapter therebetween.

(2) Description of the Prior Art

It is a well-known conventional technique to connect a coaxial cable with one of electronic devices such as TV, CB, FM radio receiver or amateur radio systems by means of a typical F series end connector screwing to an auxiliary interface connector.

It is one of the fatal disadvantages of a connector making a joint with a coaxial cable that it is susceptible to moisture infringement from incomplete sealing between the connector body and the cable shield. A typical example for a conventional F series coaxial cable connector 10 is illustrated in FIG. 1. A coaxial cable connector 10 is composed of a connector body 11, a sleeve 12, a threaded tube 13 rotatably disposed at one end of the sleeve 12, and a nut 14 fitted over around the thread tube 13.

The connector 10 is inserted into the sleeve 12 together with a coaxial cable 15 such that the cable insulation layer with a center conductor 16 is held in the nut 14 thereby completing an assembly of the cable connector 10 with the coaxial cable 15. Braided cable shield and outer sheath of the coaxial cable 15 is disposed between the thread tube 13 and the sleeve 12. A hexagonal compression tool is used to apply a compressive force on the sleeve 12 so as to forcibly make a sealed engagement between the sleeve 12 and the outer sheath of the coaxial cable 15. However, the strength of force exerted on the cable joint by the compression tool operators differs considerably so that degree of tightness between the sleeve 12 and the cable 15 cannot be maintained at a desired level, accordingly, there exists a passage for moisture infringement therefrom and reaching the braided shield resulting in degrading signal transmission property at the joint. Hence, the possibility of moisture infringement therefrom shall be absolutely eliminated.

Accordingly, it is a must to provide an end connector which can be tightly engaged with the cable so as to prevent entry of rain water and corrosion so as to ensure durable mechanical engagement between the joint portions.

SUMMARY OF THE INVENTION

It is a first object of the present invention to provide an end connector for coaxial cable forming an annular protrusion around the end of the outer wall surface of an outer sleeve, the annular protrusion is made to reduce the diameter at the end of the outer sleeve after being squeezed so as to make a perfectly tight engagement between the end of the outer sleeve and the cable outer sheath.

It is a second object of the present invention to provide an end connector for coaxial cable forming at least an annular protrusion around near the end of the outer wall surface of an outer sleeve such that when the outer sleeve is compressed to cure inwardly, the annular protrusion is depressed inwardly by squeezing thereby perfectly engaging with the cable outer sheath to form a multiple water tight protection.

It is a third object of the present invention to provide an end connector for coaxial cable wherein a easily breakable ditch is formed between the annular protrusion and the outer wall surface of the outer sleeve so as to easily deform the annular protrusion.

The invention as well as its many advantages may be further understood by the following detailed description of the embodiments with reference to the accompanied drawings.

DETAILED DESCRIPTION OF THE PREFERRED EMBODIMENT

Embodiment 1

Figure 1:
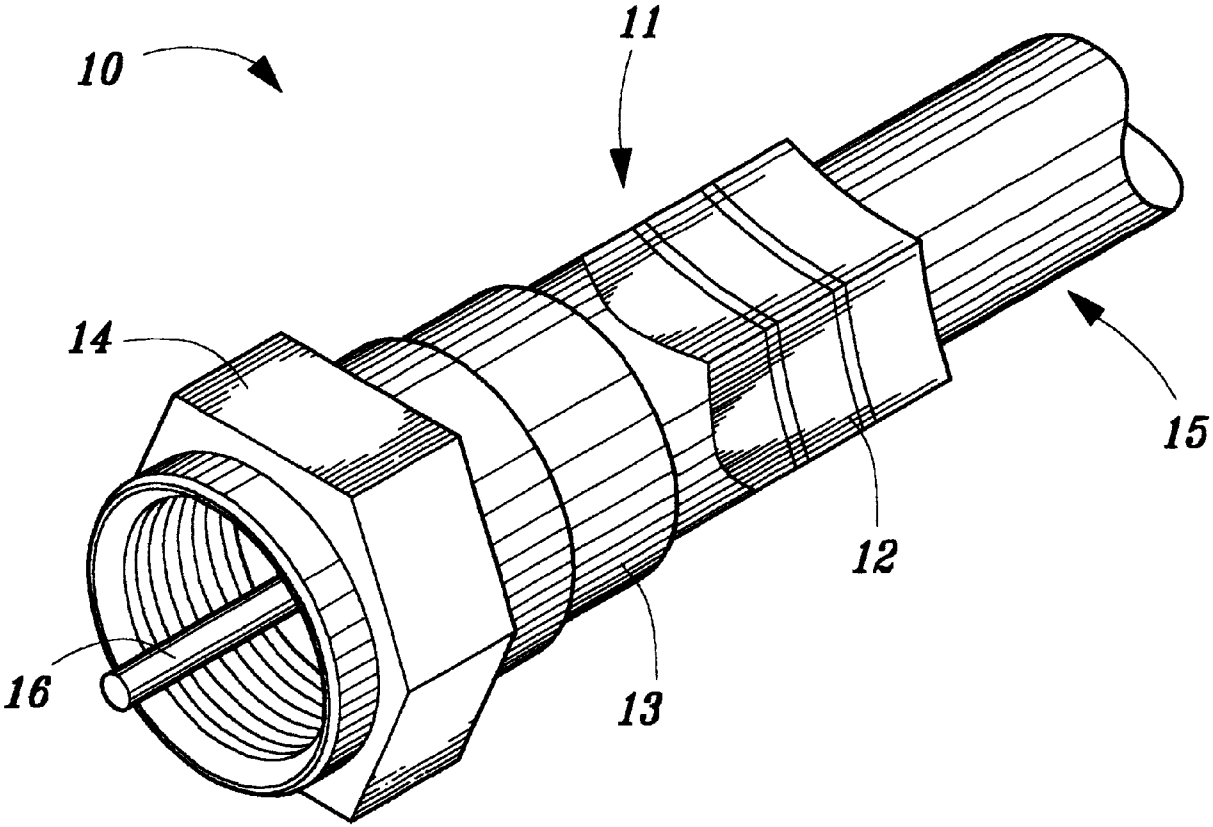
FIG. 1 PRIOR ART
FIG. 1 is a three-dimensional perspective view showing a conventional end connector in engagement with a coaxial cable.
Figure 2:
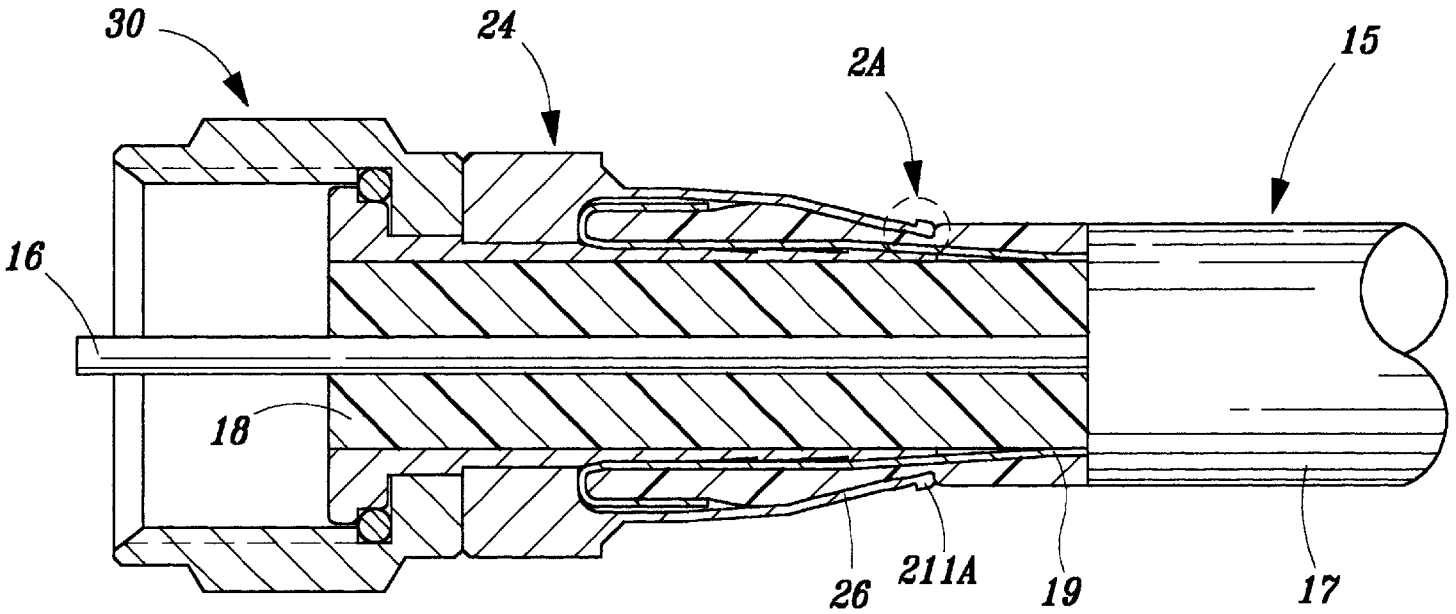
FIG. 2 is a cross sectional view showing an end connector of the present invention in engagement with a coaxial cable.

As shown in FIG. 2, a center conductor 16, an insulation layer 18, a braided shield conductor 19 and an outer sheath 17 constitute a well-known coaxial cable 15. In order to be effectively connected to terminal electronic devices, the center conductor 16 and the insulation layer 18 is removed a prescribed length to expose the center conductor 16. The braided shield conductor 19 is cambered from its terminal a prescribed length and covered on the outer sheath 17, and the cable 15 is inserted in the end connector 20.

Figure 3:
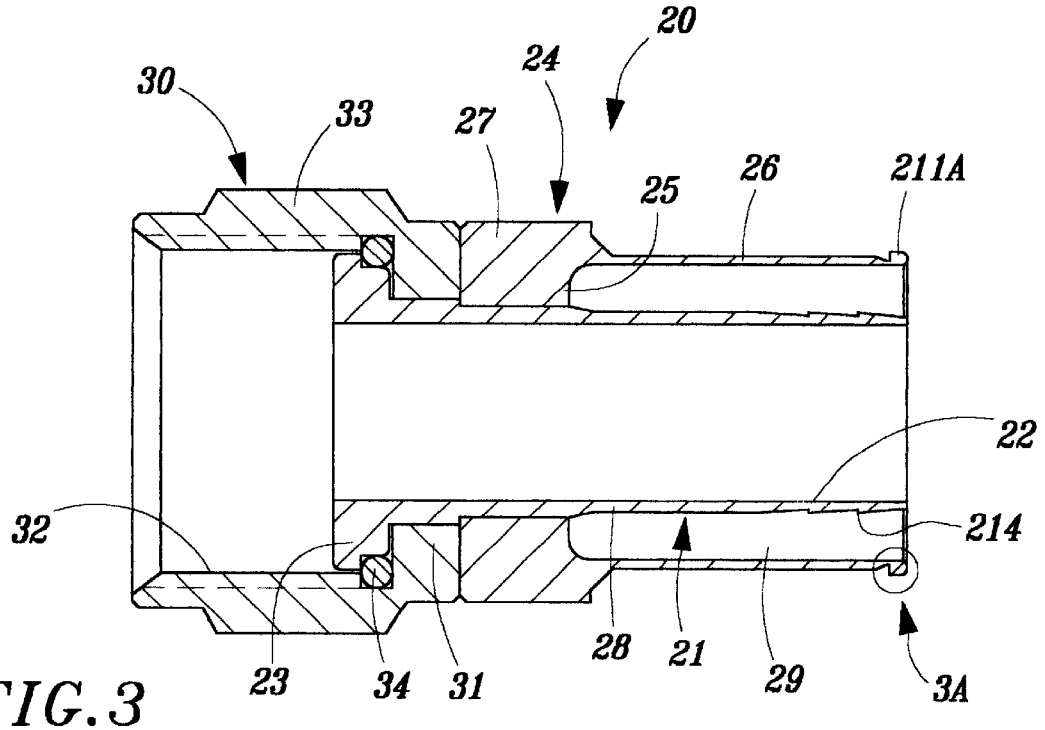
FIG. 3 is a cross sectional view of the end connector according to the present invention.
Figure 4:
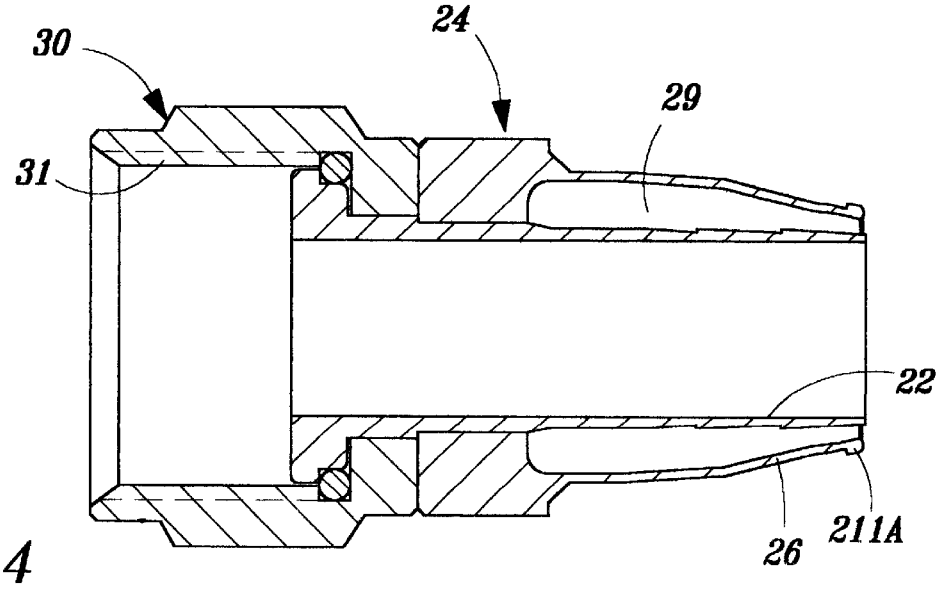
FIG. 4 is a cross sectional view of the inwardly compressed end connector of the present invention.

Referring to FIGS. 2, 3, together with FIG. 4, an end connector 20 includes a sleeve body 21 with a through hole 22 thereon, and having an outer flange 23 formed at the front end and an extended portion 28 from the rear end.

Figure 3A:
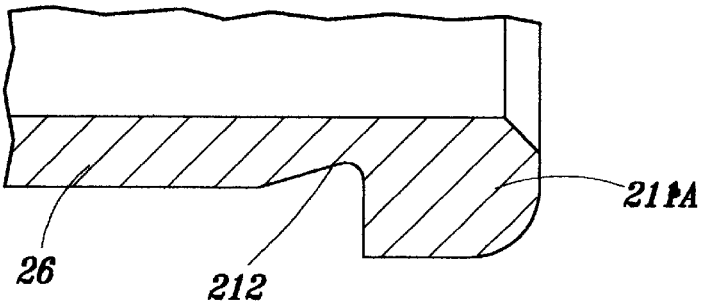
FIG. 3A is an enlarged fragmentary view taken along dotted line 3A of FIG. 3.

The end connector 20 further includes an outer sleeve 24 having an inner flange 25 encircling on the sleeve body 21, and a rear end extended portion 26 whose outer diameter and wall thickness being smaller than those of an outer sleeve body 27. The outer sleeve 24 is coaxially encircling the rear end extended portion 28 of the sleeve body 21 and an annular cavity 29 is formed therebetween. The inner wall surface of the rear end extended portion 26 is formed flat and smooth, while the outer wall surface thereof has a conventional serrated portion 214. The end of outer wall surface of the rear end extended portion 26 is formed into an annular protrusion 211A, and an easily breakable annular ditch is interposed between the annular protrusion 211A and the rear end extended portion 26, as shown in FIG. 3A.

The end connector 20 further includes a nut lock 30 at its front end, and a flange 31 inwardly bent at the end connector. The flange 31 is sandwiched between the outer flange 23 and the outer sleeve body 27. Several screw threads 32 are provided on the inner wall surface of the nut lock 30, while its outer surface is formed into a flat shaped screw nut 33 so that the end connector 20 can be tightened to a receiver or a terminal electronic device with a spanner or other equivalent tools. A sealant 34 is filled between the outer flange 23 and the flange 31 so as to evade infringement of moisture through the contact surface between the outer sleeve body 27 and the flange 31.

Figure 2A:
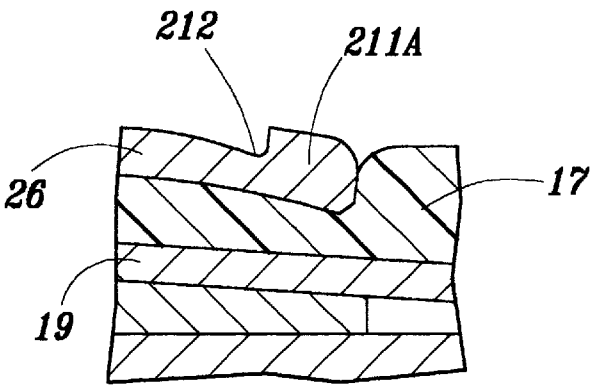
FIG. 2A is an enlarged fragmentary view taken along dotted line 2A of FIG. 2.

As shown in FIG. 2A, in order to conjoin the end connector 20 with the cable 15, the cable 15 is inserted into the end connector 20 while the center conductor 16 exposed outside and insulation layer 18 stretch into the sleeve body 21, while the braided conductor 19 and the outer sheath 17 stretch to the place between the rear end extended portion 28 of the sleeve body 21 and the rear extended portion 26 of the outer sleeve 24. A compression tool which causes reduction of diameter of portion 26 compresses the latter portion 26 radially inward. Since the diameter of the outer sleeve end is reduced by squeezing the annular protrusion 211A so that the annular protrusion 211A can be forcibly engaged with the cable outer sheath 17.

Since there is a ditch 212 formed between the rear end extended portion 26 and the annular protrusion 211A such that the annular protrusion 211A is easily deformed thereat and reduces the diameter of the outer sleeve 24 at its end thereof. As a result, the deformed annular protrusion 211A can be perfectly engaged with the cable outer sheath 17 so as to prevent moisture from entering into the connector thereby ensuring durable mechanical connection between the components.

Figure 5:
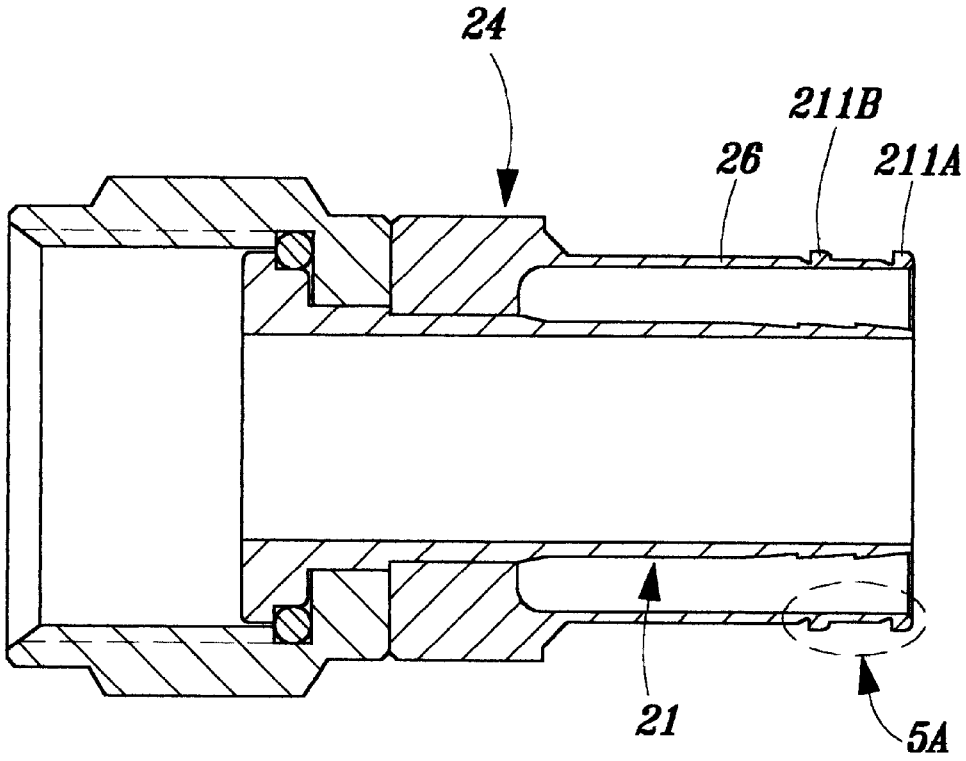
FIG. 5 is a cross sectional view of an end connector in another embodiment of he present invention.
Figure 5A:
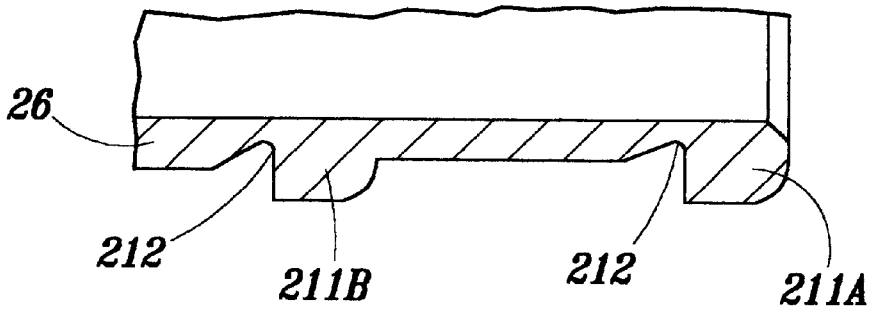
FIG. 5A is an enlarged fragmentary view taken along dotted line 5A of FIG. 5.
Figure 6:
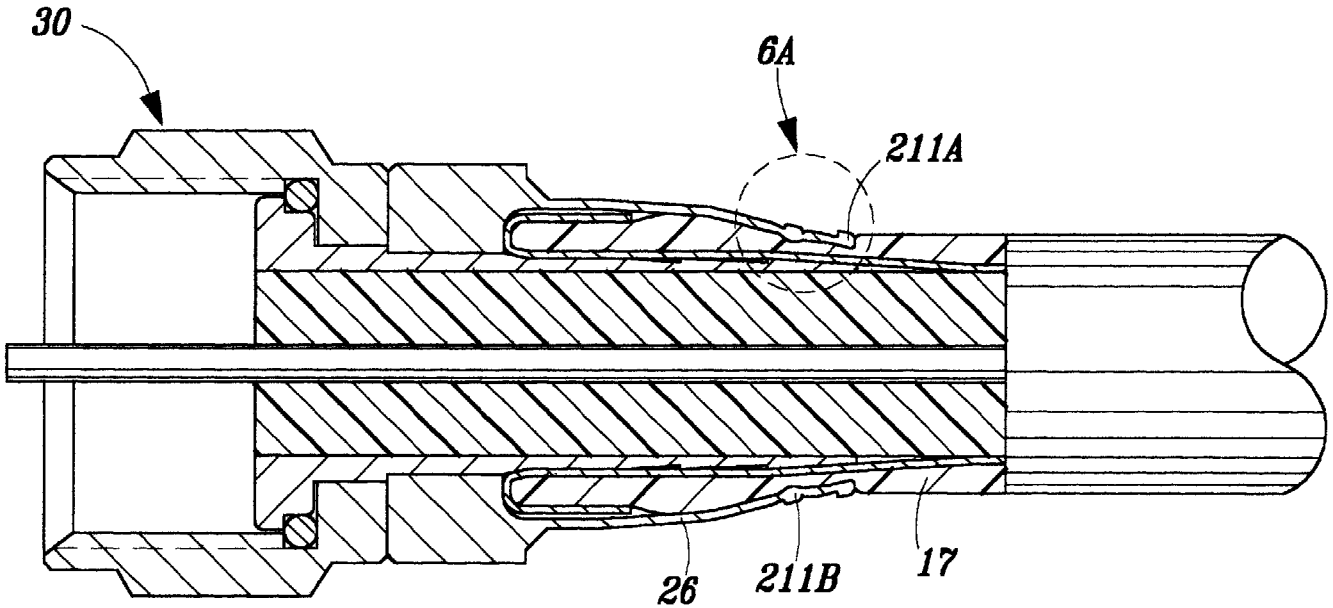
FIG. 6 is a cross sectional view showing an end connector of the present invention in engagement with a coaxial cable.
Figure 6A:
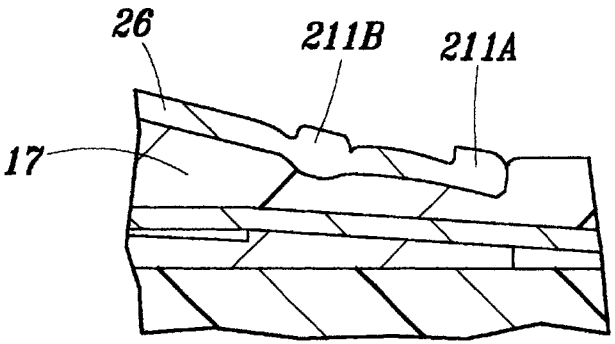
Figure 7:
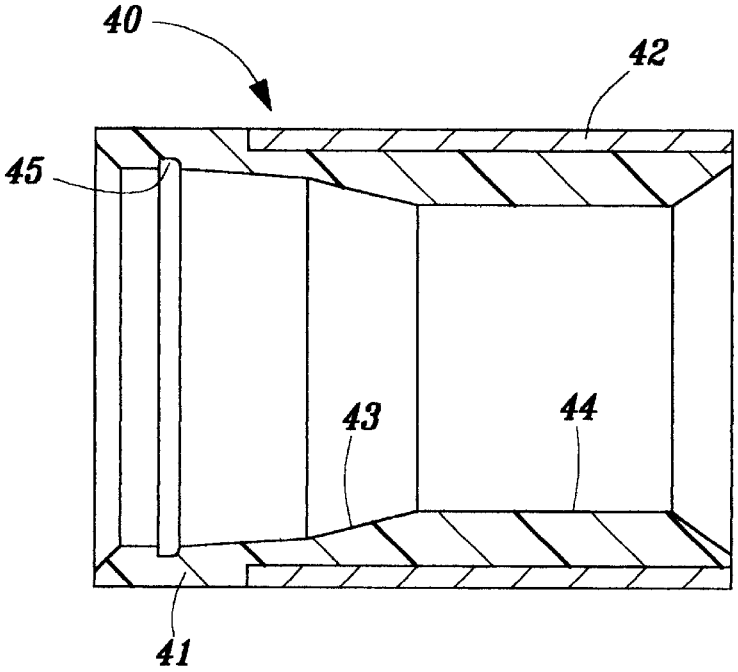
FIG. 7 is a cross sectional view of an adaptor according to the present invention.
Figure 8:
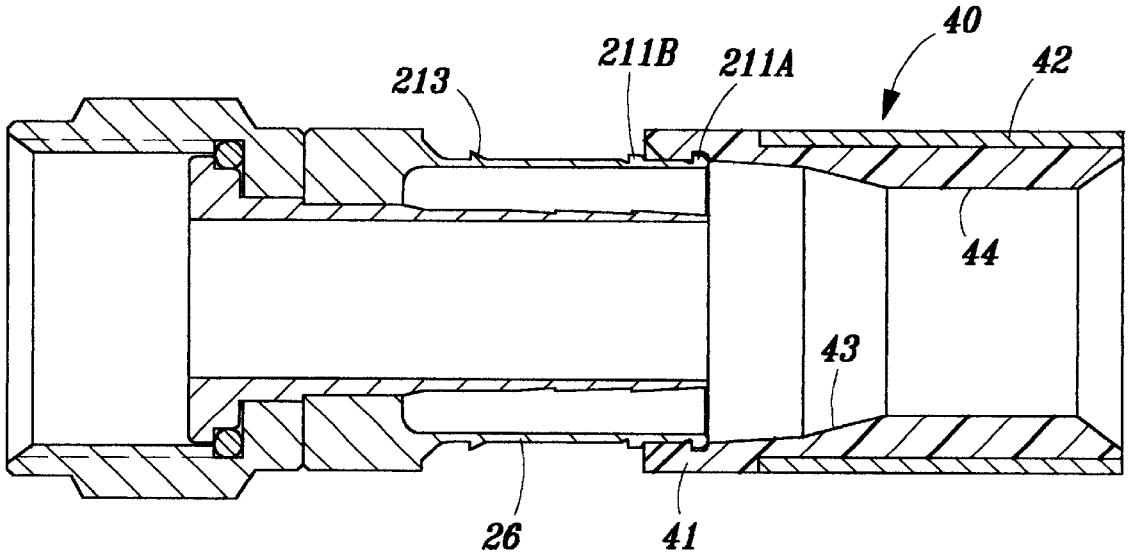
FIG. 8 is cross sectional view showing wherein the adapter of FIG. 7 is pre-clad on the outer sleeve.
Figure 9:
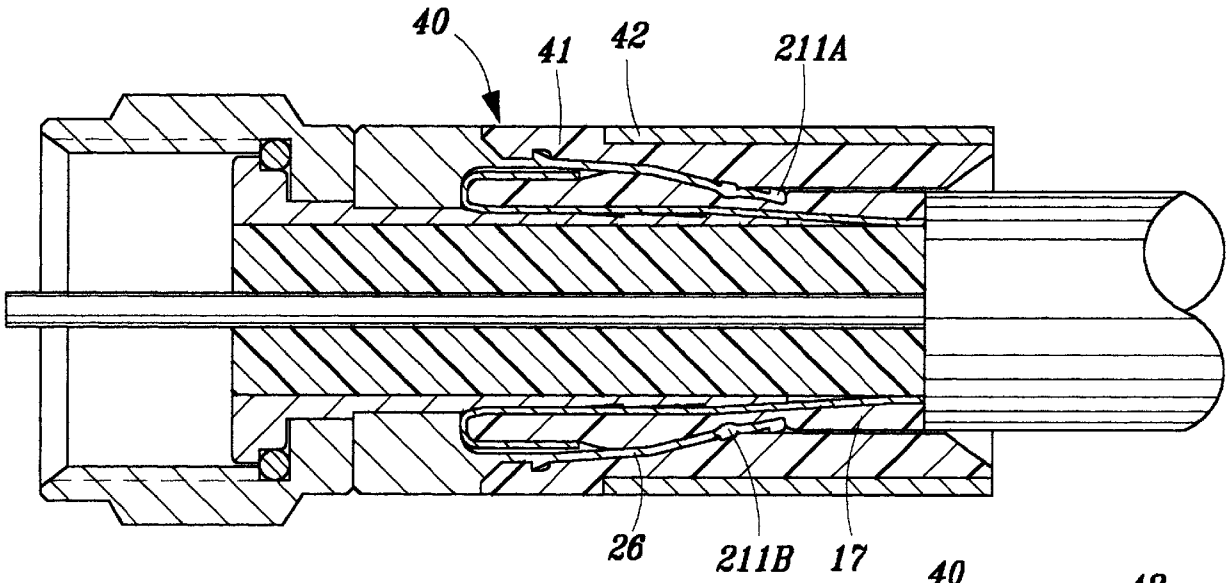
FIG. 9 is a cross sectional view wherein the end connector of FIG. 8 is in engagement with a coaxial cable.
Figure 10:
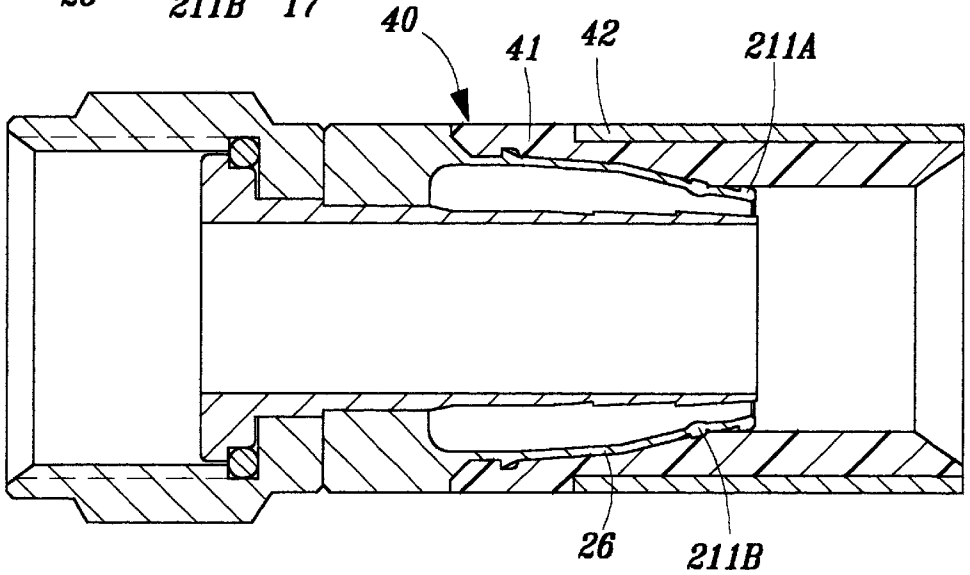
FIG. 10 is a cross sectional view of the squeezed end connector of FIG. 8.

Referring to FIGS. 5 and 6, in this embodiment, another annular protrusion 211B is formed near the end of the outer wall surface of the rear end extended portion 26. With this structure, in case the portion 26 of the outer sleeve 24 is compressed, the annular protrusion 211B would be depressed inwardly while the inner wall surface of the portion 26 upheavals. Thus, both annular portions 211A and 211B can be forcibly and directly in a tight engagement with the cable outer sheath 17 (see FIG. 6A) resulting in multiple moisture proof sealing. As shown in FIG. 5A, an annular ditch 212 formed between the rear end extended portion 26 and the annular protrusion 211B facilitates deformation of the annular protrusion 211B from the ditch 212.

Referring to FIGS. 7 through 10, in the present invention, a common compression means (such as a compression tool and an adaptor) can be used to compress the rear end extended portion 26 of the outer sleeve 24 inwardly in a radiant state so as to reduce the diameter of the portion 26.

Furthermore, an adapter 40 including an adapter body 41 and a fitting ring 42 around the body is covering the rear end extended portion 26 of the outer sleeve 24. A truncated cone shaped hole 43 and a cylindrical hole 44 are bored both facing to longitudinal direction in the adapter body 41, and an annular groove 45 is formed near the base of the truncated cone shaped hole 43. When assembling, the adapter 40 may be pre-installed with the outer adapter 24, and inlaid in the annular groove 45 by the annular protrusion 211A so as to simplify the operator's working procedure.

After the cable 15 has been completely inserted into the end connector 20, a compression tool is used to compress the adapter 40 so as to force the portion 26 into the hole 43 thereby deforming the portion 26 inwardly into a radiant state having a reduced diameter. The annular protrusion 211A makes the diameter at the end of the outer sleeve 24 reduced in accordance with the ramp of the truncated cone shaped hole 43. On the other hand, the annular protrusion 211B is squeezed and depressed inwardly, such that both annular protrusions 211A and 211B are forced to directly in tight engagement with the cable outer sheath 17. Finally an annular protuberance 213 on the rear end extended portion 26 is inlaid in the annular groove 45. With this structure the end connector and the cable achieve multiple tight annular sealing therebetween.

Figure 12A:
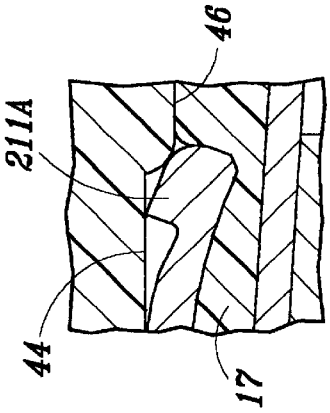
FIG. 12 is a cross sectional view showing wherein the end connector is engaged with the adaptor of FIG. 11 by squeezing.
Figure 11:
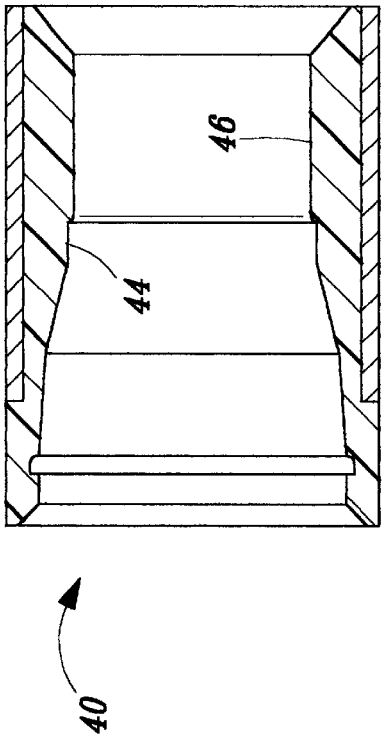
FIG. 11 is a cross sectional view of an adaptor in an embodiment of the present invention.
Figure 12:
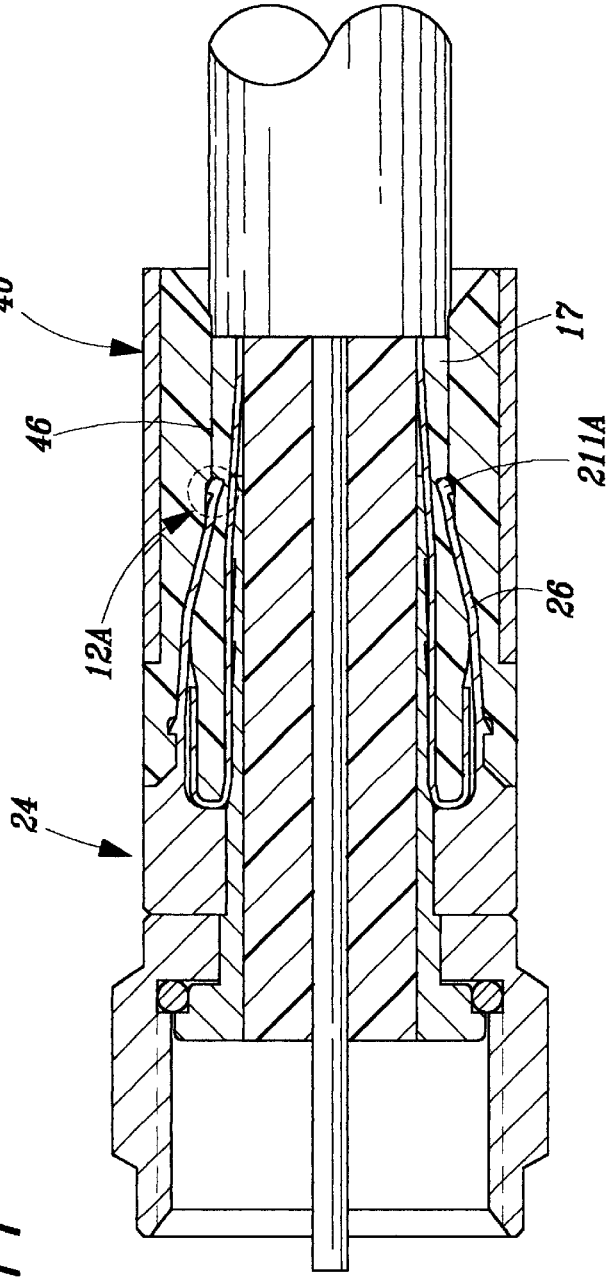

Referring to FIGS. 11 and 12, the adaptor 40 in an embodiment of the present invention is shown. An annular protruded flank 46 is formed around the inner wall surface of a cylindrical hole 44. When the adaptor 40 is squeezed to engage with the outer sleeve, the annular protrusion 211*a* which is inlaid in the annular protruded flank 46 is squeezed herein to obtain a further greater deformation so that the annular protrusion 211*a* exacerbatingly increases conjoining force with the cable outer sheath 17 by more deeply biting with the latter as shown in FIG. 12A.

Figure 13:
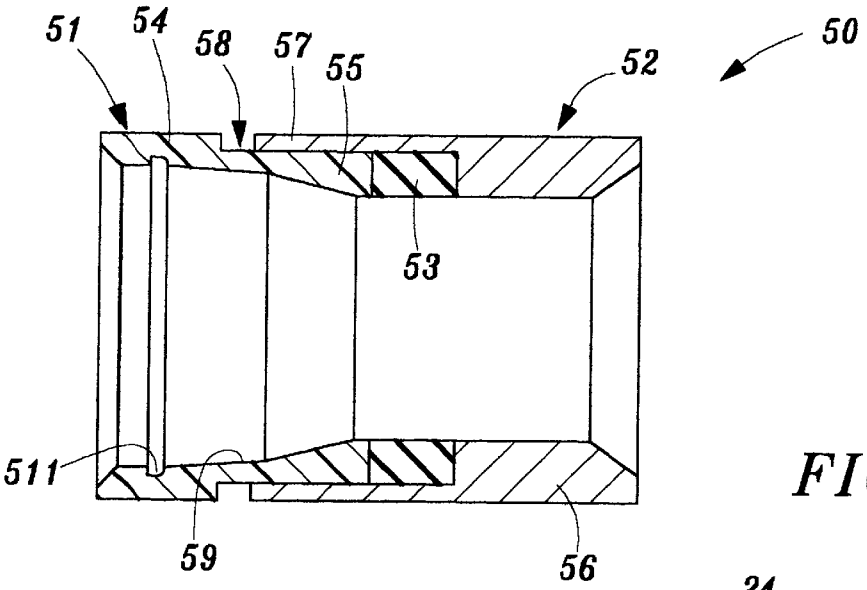
FIG. 13 is a cross sectional view of an adaptor in another embodiment of the present invention.
Figure 14:
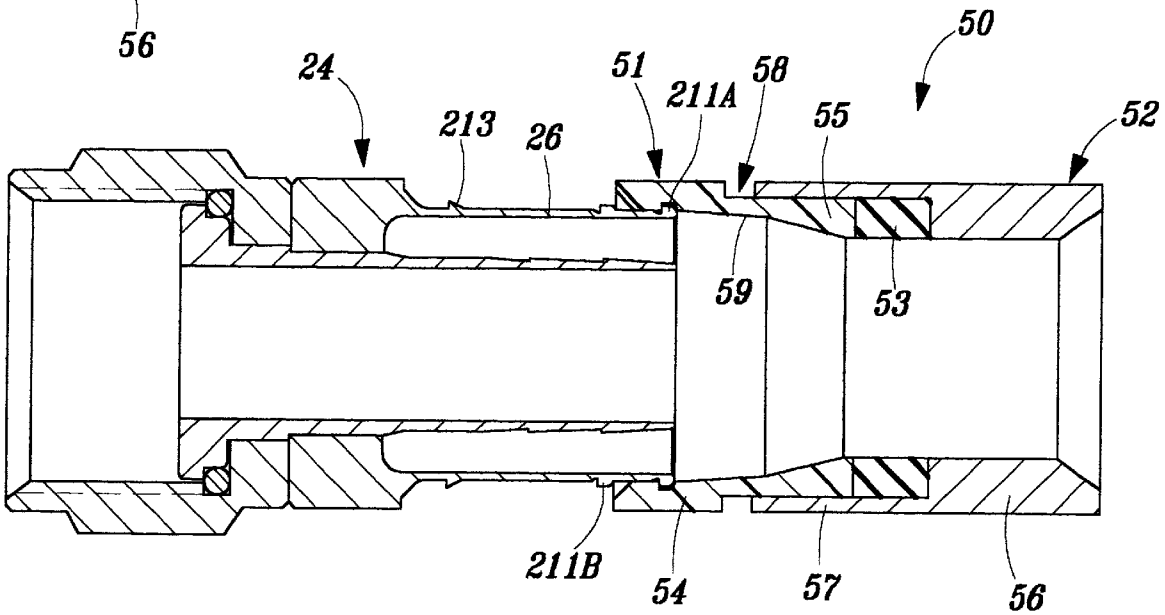
FIG. 14 is a cross sectional view showing wherein the adaptor of FIG. 13 is pre-clad on the connector of the present invention.

Referring to FIGS. 13 and 14, the drawings show an adaptor 50 in another embodiment of the present invention. The adapter 50 includes a first adapter body 51, a second adapter body 52, and an annular moisture proof sealant 53 interposed between the first adapter body 51 and the second adapter body 52. The first adapter body 51 has an end portion 54 and an interface 55, and a truncated cone shaped hole 59 therein facing against the longitudinal direction. An annular groove 511 is formed at the front end of the hole 59. The second adapter body 52 has a flange 56 and a tubular end portion 57. The interface 55 of the first adapter body 51 is tightly conjoined to the inner wall of the tubular end portion 57 mechanically, and forming a clearance 58 between the end portion 54 and the tubular end portion 57. The annular moisture proof sealant 53 is made of an elastic rubber.

Figure 15:
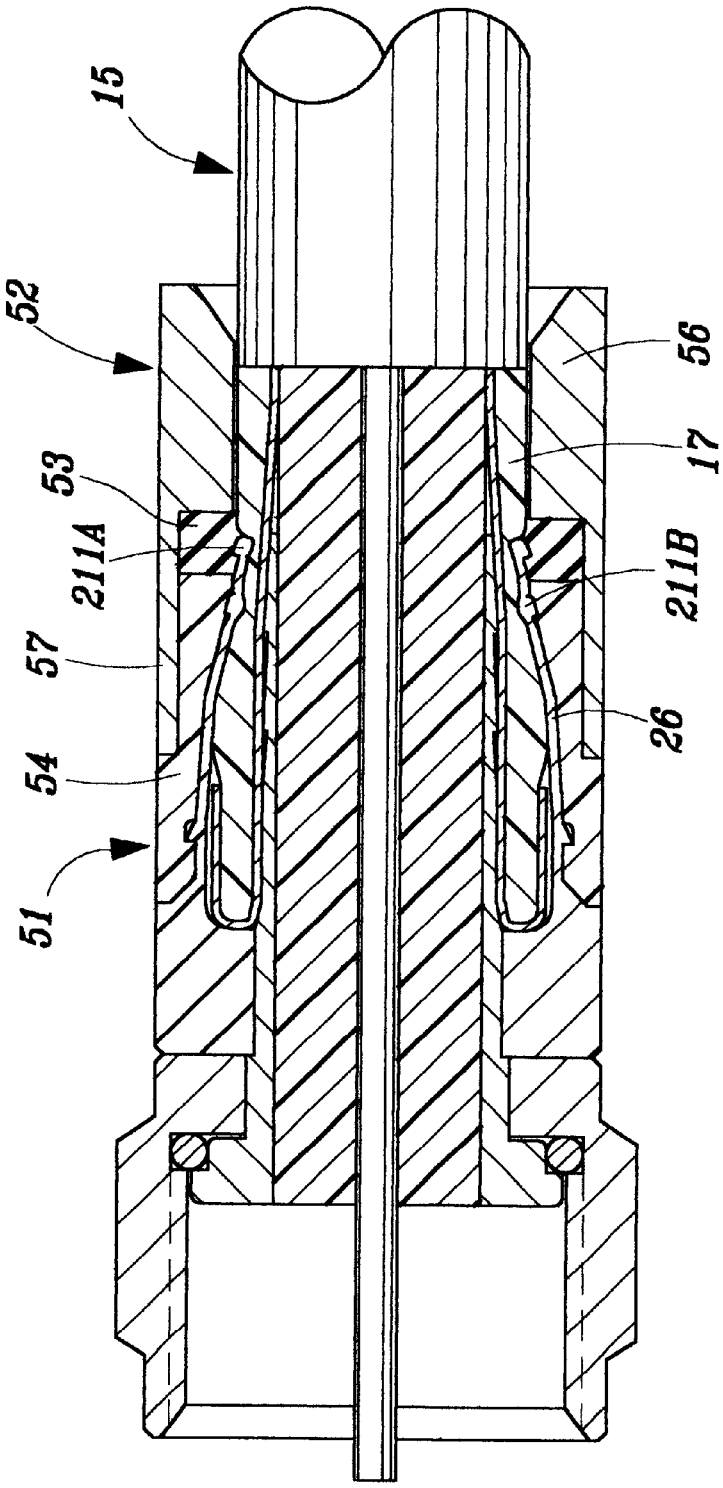
FIG. 15 is a cross sectional view wherein the end connector of FIG. 14 is in engagement with a coaxial cable.

By means of a compression tool to compress the adaptor 50 so as to force the portion 26 into the hole 59 thereby deforming the portion 26 inwardly into a radiant state having a reduced diameter. At this time, the annular protrusion 211A and/or the annular protrusion 211B are/is deformed, the protrusion 211A is compressed inwardly and reduces its diameter, on the other hand, the protrusion 211B is inwardly depressed so that the annular protrusion 211A and/or the annular protrusion 211B are/is forced to directly in tight engagement with the cable outer sheath 17. At the last compression the tubular end portion 57 is forced to remove forward and clogs the clearance 58 so as to cause the tubular end portion 57 to contact the end surface of the end portion 54. At this moment, due to accuracy of compression between the first adapter body 51 and the second adapter body 52, the sealant 53 is squeezed to deform so as to directly and tightly engage with the cable outer sheath 17. The sealant 53 after compression is removed to a place between the rear end extended portion 26 and the outer wall of the cable sheath 17 thereby achieving a tight annular sealing effect as shown in FIG. 15.

Figure 16:
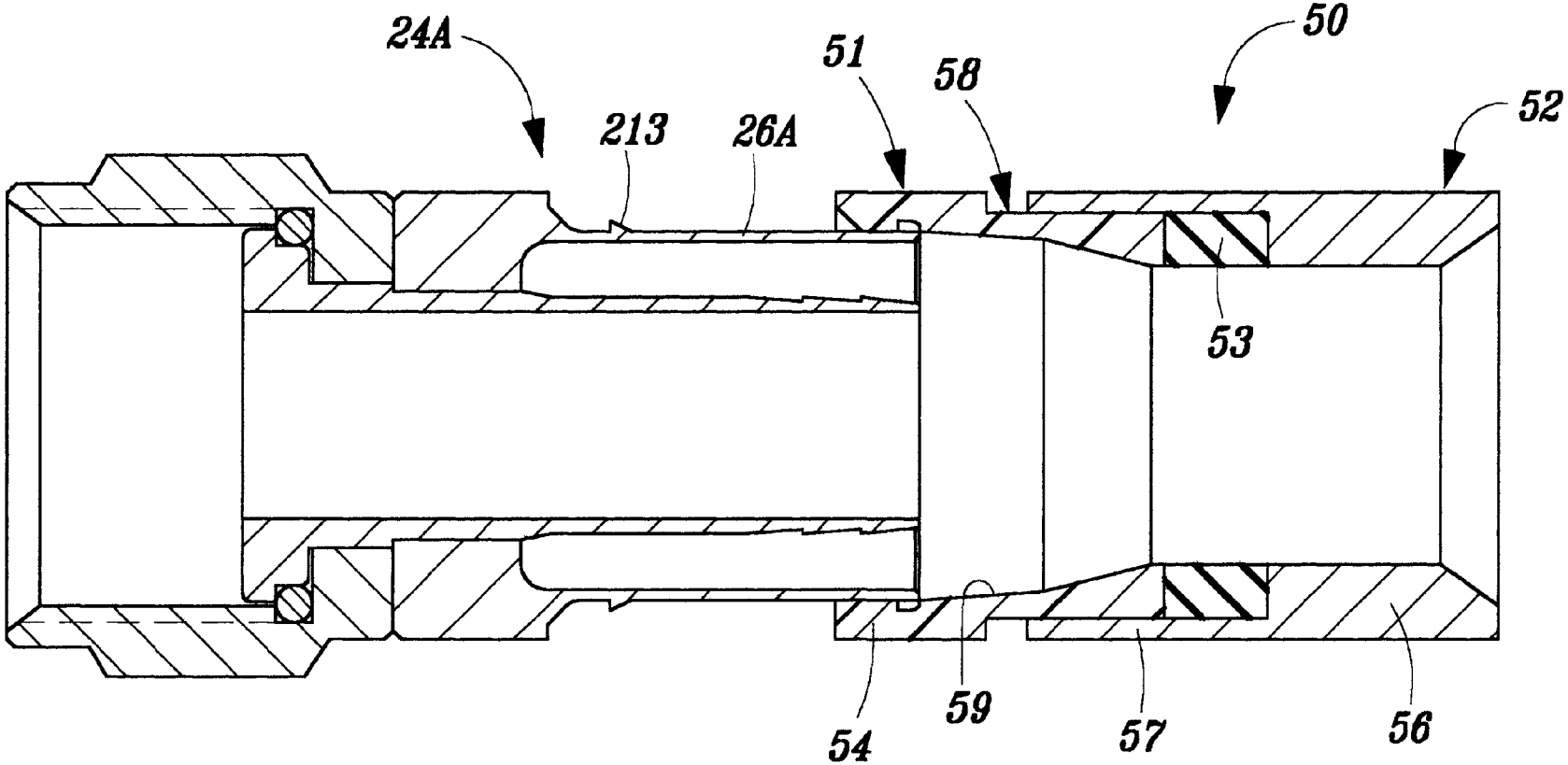
FIG. 16 is a cross sectional view of an end connector in one more embodiment of the present invention.
Figure 17:
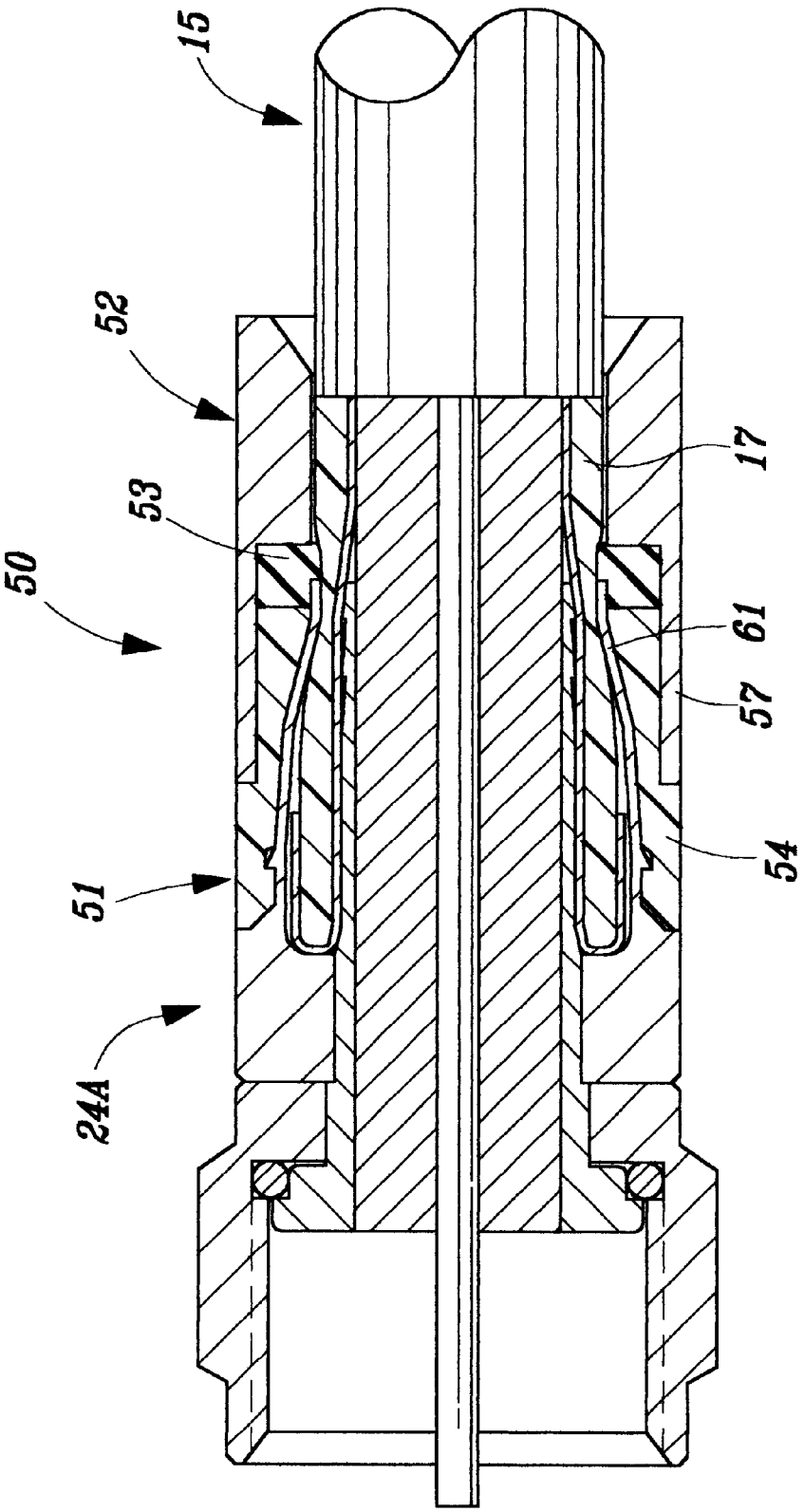
FIG. 17 is a cross sectional view showing wherein the end connector of FIG. 16 is engagement with a coaxial cable.

Referring to FIGS. 16 and 17, the drawings show an outer sleeve 24A used in more embodiment of the present invention. The annular protuberance 213 is formed near the front end of the outer wall surface of the rear end extended portion 26A. Since the terminal of the outer wall surface is a flat and smooth surface, therefore, in case the adaptor 50 (see FIG. 13) is compressed with a compression tool, the rear end extended portion 61 is squeezed by the truncated cone shaped hole 59 to deform inwardly into a radiant state having a reduced diameter. At the last compression stage, the tubular end portion 57 is forced to remove forward and clogs the clearance 58 so as to cause the tubular end portion 57 to contact the end surface of the end portion 54. At this moment, due to compression between the first and the second adapter bodies 51, 52, the sealant 53 is squeezed to deform so as to directly and tightly engage with the cable outer sheath 17. The sealant 53 after compression is removed to a place between the rear end extended portion 61 and cable sheath 17 thereby the rear end extended portion 26A can be perfectly in tight engagement with the outer cable sheath 17.

Those who are skilled in the art will readily perceive how to modify the invention. Therefore, the appended claims are to be constructed to cover all equivalent structures, which fall within the true scope and spirit of the invention.

What is claimed is:

1. An end connector for connecting a coaxial cable to a threaded interface connector provided with a screw threaded interface connector, said end connector coaxially mounted on the coaxial cable and comprising: an outer sleeve; a sleeve body coaxially disposed in said outer sleeve; an adapter; and a nut lock encircling said sleeve body, wherein:

said outer sleeve has a main body with a rear end extended portion having a smooth inner wall surface; and wherein said adapter encloses said outer sleeve, and has a first adapter body, a second adapter body coaxially encircling said first adapter body, and an annular moisture proof sealant interposed between said first adapter body and said second adapter body, a truncated cone shaped hole formed inside of said first adapter body facing in a longitudinal direction thereof, whereby, after inserting the coaxial cable into said connector, said rear end extended portion of said outer sleeve is compressed to deform inwardly by said truncated cone shaped hole, causing said annular sealant to be compressed between said first adapter body and said second adapter body so as to directly and tightly engage an outer sheath of the coaxial cable.

2. An end connector for connecting a coaxial cable to a threaded interface connector provided with a screw threaded interface connector, said end connector coaxially mounted on the coaxial cable and comprising: an outer sleeve; a sleeve body coaxially disposed in said outer sleeve; an adapter; and a nut lock encircling said sleeve body, wherein:

said outer sleeve has a main body with a rear end extended portion having a smooth inner wall surface and an outer wall surface, a major portion of which is a smooth surface, and wherein said adapter encloses said outer sleeve, and has a first adapter body, a second adapter body coaxially encircling said first adapter body, and an annular moisture proof sealant interposed between said first adapter body and said second adapter body, a truncated cone shaped hole formed inside of said first adapter body facing in a longitudinal direction thereof, whereby, after inserting the coaxial cable into said connector, said rear end extended portion of said outer sleeve is compressed to deform inwardly by said truncated cone shaped hole, causing said annular sealant to be compressed between said first adapter body and said second adapter body so as to directly and tightly engage an outer sheath of the coaxial cable.

3. The end connector as claimed in claim 2, further comprising an annular protrusion formed around an end of the outer wall surface of said rear end extended portion of said outer sleeve, said annular protrusion engaging said annular moisture proof sealant after compression of the rear end extended portion, said annular protrusion being compressed so as to be in tight engagement with the outer sheath of the coaxial cable.

4. The end connector as claimed in claim 3, further comprising a ditch formed in the outer wall surface of the rear end extended portion of said outer sleeve adjacent to said annular protrusion.

5. The end connector as claimed in claim 2, further comprising at least one annular protrusion formed around the outer wall surface adjacent to an end of said rear end extended portion of said outer sleeve, said annular protrusion being compressed by the adapter so as to be in watertight engagement with the outer sheath of the coaxial cable.

6. The end connector as claimed in claim 5, further comprising a ditch formed in the outer wall surface of the rear end extended portion of said outer sleeve adjacent to said at least one annular protrusion.

* * * * *